US005802754A

United States Patent [19]

Watanabe

[11] Patent Number: 5,802,754

[45] Date of Patent: Sep. 8, 1998

[54] IDENTIFICATION PLATE ATTACHMENT STRUCTURE

[75] Inventor: Iwao Watanabe, Atsugi, Japan

[73] Assignee: Nissan Motor Co., Ltd., Kanagawa, Japan

[21] Appl. No.: 639,096

[22] Filed: Apr. 24, 1996

[30] Foreign Application Priority Data

Apr. 27, 1995 [JP] Japan ..... 7-103391

[51] Int. Cl.[6] ..... G09F 3/04

[52] U.S. Cl. ..... 40/630; 40/911; 40/912; 411/258; 411/160

[58] Field of Search ..... 40/636, 631, 911, 40/912, 913, 914; 411/258, 82, 930, 531, 187, 160, 542

[56] References Cited

U.S. PATENT DOCUMENTS 4,657,460 4/1987 Bien ..... 411/258
4,922,573 5/1990 Miller et al. ..... 411/258 X
5,636,953 6/1997 Jaeger et al. ..... 411/258 X

FOREIGN PATENT DOCUMENTS 203168 2/1938 Switzerland ..... 40/912

*Primary Examiner*—Cassandra H. Davis
*Attorney, Agent, or Firm*—McDermott, Will & Emery

[57] ABSTRACT

An identification (ID) plate attachment structure is provided. According to this structure, adhesive agent spreads over not only one face of an attachment portion of an ID plate, but also the opposite face thereof owing to the provision of a plurality of through holes which the attachment portion of formed with. In attaching the ID plate to a mounting boss of a vehicular main component, such as, a transaxle, via a bolt, the pressure exerted by a head of the bolt in the process of tightening the bolt displace the adhesive agent disposed on the one face of the attachment portion to the side on the opposite face thereof via the through holes. Owing to the provision of the adhesive agent, a roughly equal frictional coefficient is obtained between the bolt and the attachment portion and between the attachment portion and the mounting boss and breakage of the ID plate during installation due to bolt tightening is prevented.

24 Claims, 3 Drawing Sheets

IDENTIFICATION PLATE ATTACHMENT STRUCTURE

BACKGROUND OF THE INVENTION

1. Field of the Invention

The present invention relates to a structure for attaching an identification (ID) plate to a vehicular component and a method of attaching an identification plate to a vehicular component.

2. Description of the Prior Art

In the United States of America, it is mandatory for automotive manufacturers to attach ID plates to veichular main components, such as engines and transmissions. Each of the ID plates must carry a manufacturer's name and a lot number of a vehicular component. This measure has been adopted for anti-theft of automotive vehicles.

A structure for attaching ID plates to such vehicular components which has been proposed is shown in FIGS. 4 and 5. According to this known structure, in attaching an ID plate a to a mounting boss b of a vehicular main component, the ID plate a has one face c covered with an adhesive agent e. The adhesive agent e covers a shadowed area shown in FIG. 5. The shadowed area e extends to and limited by a groove d forming a separable line. With the adhesive agent e, the ID plate a is bonded to the boss b and then fixed thereto by tightening a bolt f extending through the ID plate a and threaded into the boss b. In tightening the bolt f, a wrench is used to turn a hexagonal bar h projecting from a bolt head g to turn the bolt f. After completion of tightening the bolt f, the hexagonal projection h is wrenched off as indicated by two-dot chain line in FIG. 4.

Any individual vehicular components can be easily identified with ID plates attached thereto even if they or at least one of them are used in another automotive vehicle. If one dares to remove an ID plate a to avoid such identification, the ID plate a would be separated at the separable line formed by the groove d, leaving the portion thereof on the mounting boss b as it is. In this case, it is easily recognized that this vehicular component was used in some other stolen automotive vehicle.

However, according to this structure, since the frictional coefficient between the ID plate a and the boss b and that between the plate a and the head g of the bolt f are not equal, careful control of tightening torque with which the bolt f is turned is needed to prevent breakage of the ID plate a along the groove d during tightening the bolt f.

Thus, there is need for a structure for or a method of attaching an ID plate to a vehicular component in which breakage or premature detachment of the ID plate is prevented.

SUMMARY OF THE INVENTION

According to one aspect of the invention, there is provided an identification plate attachment structure, comprising:

a vehicular component;

an identification (ID) plate;

a bolt extending through said ID plate and entering into said vehicular component, said bolt having a head; and an adhesive agent including a first portion disposed between one face of said ID plate which is opposed to said vehicular component and said vehicular component and a second portion disposed between the adjacent opposite face of said ID plate and said head of said bolt.

According to another aspect of the invention, there is provided a method of attaching an identification (ID) plate to a vehicular component by a headed bolt with an adhesive agent between the ID plate and the vehicular component, comprising the steps of:

forming a plurality of through holes around the bolt;

placing the adhesive agent on the ID plate on that one face thereof which is opposed to the vehicular component; and tightening the bolt so that said through holes allow a portion of the adhesive agent to be displaced out of a space disposed on said one face of the ID plate to a space disposed on the opposite face of the ID plate.

DETAILED DESCRIPTION OF THE INVENTION

Figure 1:
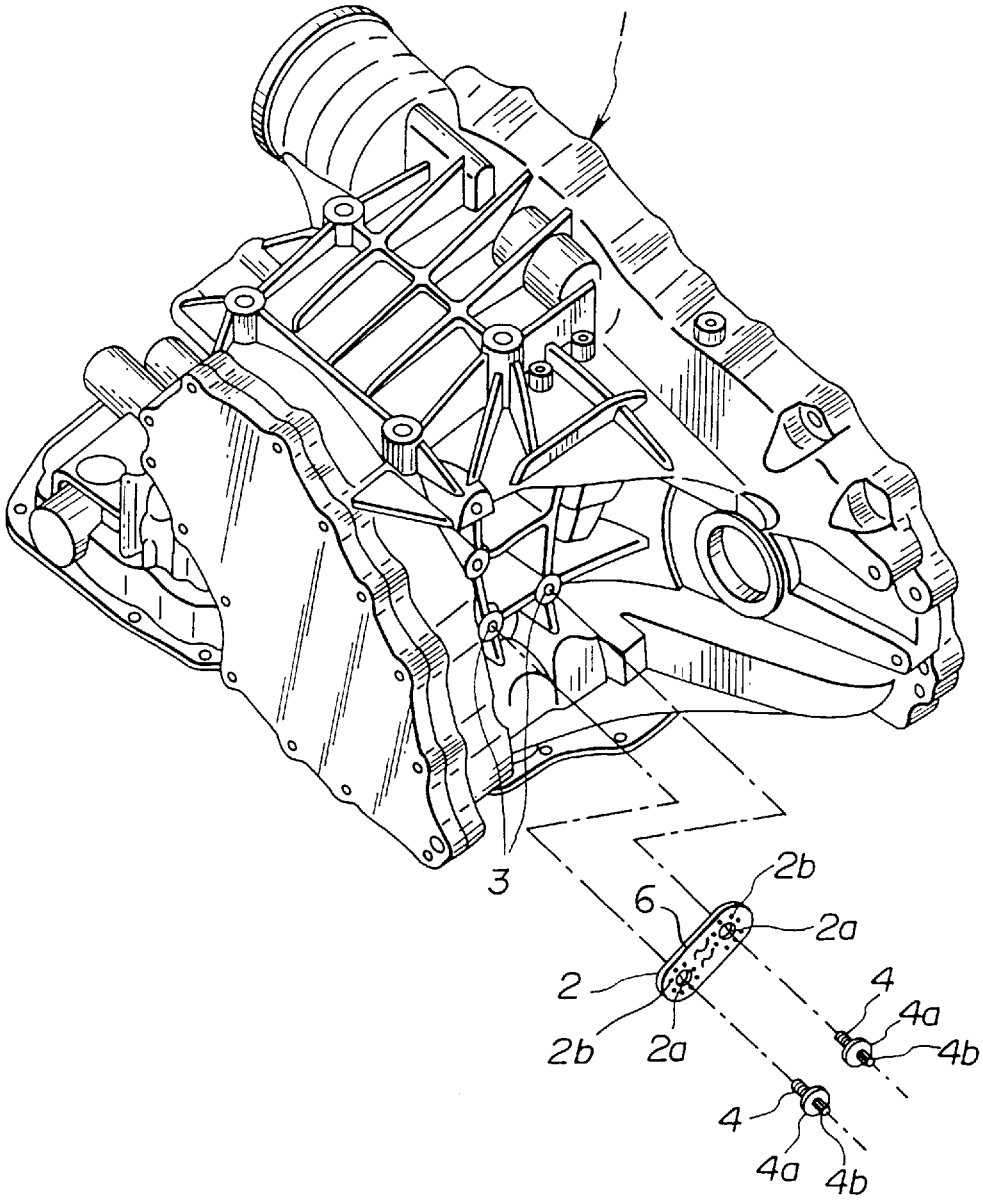
FIG. 1 is a perspective exploded view of a transaxle, as a vehicular main component, and an ID plate with bolts.

FIG. 1 shows a vehicular transaxle 1, as a vehicular main component, with two mounting bosses 3, an ID plate 2 adapted to be attached to the transaxle 1 at the bosses 3, and two bolts 4. At one and opposite end portions, the ID plate 2, which has a manufacture's name and a lot number 5 of the transaxle 1, is attached to the bosses 3. One end portion of the ID plate 2 is shown in FIG. 2.

Figure 2:
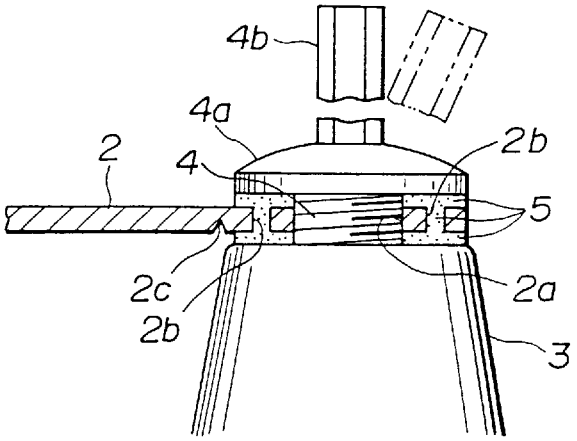
FIG. 2 is a fragmentary, partly sectioned, view of an ID plate attachment structure according to the invention.
Figure 3:
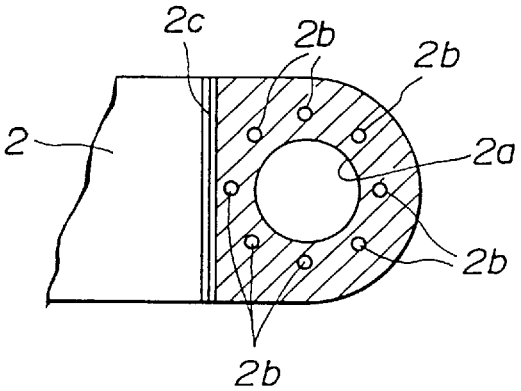
FIG. 3 is a fragmentary bottom plan view of the ID plate used in the structure in FIG. 2.
Figure 4:
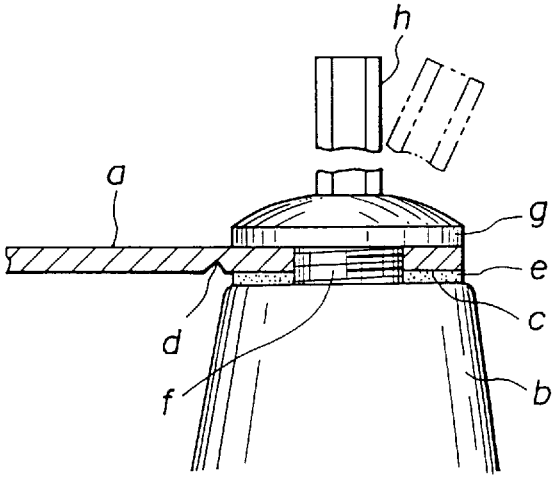
FIG.4 PRIOR ART
FIGS. 4 and 5 are similar views to FIGS. 2 and 3, illustrating the before mentioned known ID plate attachment structure.
Figure 5:
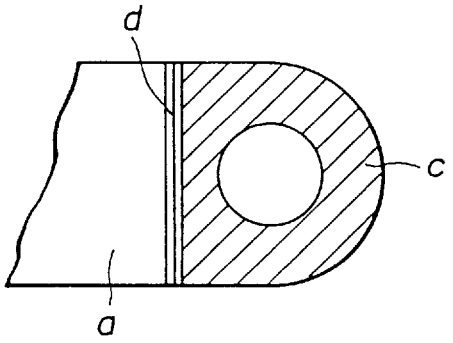
FIG.5 PRIOR ART

In FIG. 3, the ID plate 2 is illustrated as viewed from the bottom in FIG. 2 with all of the associated parts or portions removed. As readily seen from FIGS. 1 and 3, at one and opposite end portions thereof, the ID plate 2 is formed with a groove 2*c* forming a separable line. The groove 2*c* has a V-shaped cross sectional profile and it is formed on that face of the ID plate 2 which is disposed more closely to the boss 3 than the opposite face thereof is. The ID plate 2 is dividable into a main or major plate portion on which the manufacturer's name and the lot number are provided and two attachment portions, one of which is indicated by shadowed lines in FIG. 3. Each of the attachment portions of the ID plate 2 is formed with a bolt hole 2*a* through which one of the bolts 4 extends and a plurality of, eight (8) in this embodiment, small through holes 2*b* surrounding the bolt hole 2*a*. Each of the bolts 4 has a head 4*a*. Prior to assembly, each of the bolts 4 has a hexagonal bar 4*b* projecting from the head 4*a*.

As best seen in FIG. 2, the holes 2*b* proximate the bolt 4 are disposed between the head 4*a* and the boss 3. These holes 2*b* serve as means for establishing fluid communication between a first portion of an adhesive 5 disposed between one face of the ID plate 2 which is opposed to the boss 3 of the transaxle 1 and the boss 3 and a second portion disposed between the opposite face of the ID plate 2 and the head 4*a*. In this embodiment, "MALTIBOND330" made by Loctite corporation is used as adhesive and "ACTIBETA7386" or "ACTIBETA7387", both being made by the above corporation, is used as hardener.

Upon attachment of the ID plate 2 to the boss 3 of the transaxle 1, the adhesive agent 5 is put on that face of the ID plate 2, within the attachment portion as indicated by the shadowed area in FIG. 3, which is opposed to the boss 3. With the attachment portion of the ID plate 2 placed on the boss 3, the bolt 4 is inserted into the bolt hole 2*a* and turned to firmly extend into the boss 3 by turning the hexagonal bar 4*b* by the appropriate wrench. After completion of tightening the bolt 4, the hexagonal bar 4*b* is wrenched off as indicated by two-dot chain line in FIG. 2.

In the process of tightening the bolt 4, a portion of the adhesive agent 5 is displaced out of a space between the attachment portion of the ID plate 2 through the holes 2*b* to reach a space between the head 4*a* and the opposite face of the attachment portion of the ID plate 2.

Alternatively, the adhesive agent 5 may be put on this opposite face of the attachment portion of the ID plate 2. In this case, as the tightening of the bolt 4 proceeds, the adhesive agent 5 is displaced out of the space between the head 4*a* and the attachment portion of the ID plate 2 through the holes 2*b* to reach the space between the attachment portion of the ID plate 2 and the boss 3.

Owing to the adhesive agent 5, the frictional coefficient between the ID plate 2 and the boss 3 and that between the ID plate 2 and the head 4*a* are maintained generally equal in the process of tightening the bolt 4, so that application of torque tending to turn the ID plate 2 is avoided or at least suppressed. Thus, the probability that the ID plate 2 may be broken during tightening the bolt 4 has become almost zero.

From comparison of the above described embodiment with the prior art discussed before, it will be appreciated that there is no additional and complicated work in putting the adhesive agent 5 on the ID plate 2 in the case of the present embodiment.

As readily seen from FIG. 2, the first portion of the adhesive agent 5 disposed between the attachment portion of the ID plate 2 and the boss 3 and the second portion thereof disposed between the attachment portion of the ID plate 2 and the head 4*a* are interconnected by pillar portions of the adhesive agent 5 disposed in the holes 2*b*, respectively. This structure of the adhesive agent 5 has proved to be effective in strengthening bond between the head 4*a*, attachment portion of the ID plate 2 and boss 3.

What is claimed is:

1. An identification plate attachment structure comprising:

a vehicular component;

an identification (ID) plate having a bolt hole;

a bolt extending through said bolt hole in said ID plate and entering into said vehicular component, said bolt having a head;

an adhesive agent including a first portion disposed between a first face of said ID plate which is adjacent to said vehicular component and said vehicular component and a second portion disposed between an opposite second face of said ID plate and said head of said bolt;

wherein said ID plate includes means for establishing fluid communication between the first and second portions of said adhesive agent and for allowing said adhesive to be forced therethrough from the first face of said ID plate to the second face.

2. An identification plate attachment structure as claimed in claim 1, wherein said ID plate is formed with a groove which divides said identification plate into a main portion and an attachment portion, and wherein said bolt hole and said communication establishing means are formed in said attachment portion.

3. An identification plate attachment structure as claimed in claim 2, wherein said first portion of said adhesive agent fills a space between said vehicular component and said attachment portion of said ID plate and said second portion of said adhesive agent fills a space between said head of said bolt and said attachment portion of said ID plate.

4. An identification plate attachment structure as claimed in claim 3, wherein said bolt hole and said communication establishing means are disposed in said attachment portion of said ID plate.

5. An identification plate attachment structure as claimed in claim 1, wherein said adhesive agent includes a third portion interconnecting said first and second portions.

6. An identification plate attachment structure as claimed in claim 1, wherein said communication establishing means surround said bolt hole.

7. An identification plate attachment structure as claimed in claim 6, wherein said communication establishing means include a plurality of through holes extending from said first face of said ID plate to said opposite second face of said ID plate.

8. An identification plate attachment structure as claimed in claim 7, wherein a groove is formed on said second face of said ID plate which is disposed adjacent to said vehicular component.

9. An identification plate attachment structure as claimed in claim 8, wherein said groove has a V-shaped cross sectional profile.

10. An identification plate attachment structure as claimed in claim 8, wherein said ID plate is provided with information on the first face thereof.

11. An identification plate attachment structure as claimed in claim 1, wherein said fluid communication establishing means comprises a passage structure which is provided in addition to said bolt hole.

12. An identification plate attachment structure as claimed in claim 11, wherein said passage structure includes a passage which is separate and discrete from said bolt hole.

13. A method of attaching an identification ID plate to a vehicular component by a headed bolt with an adhesive agent between the ID plate and the vehicular component, comprising the steps of:

forming a plurality of through holes around the bolt;

placing the adhesive agent on the ID plate on one face thereof; and tightening the bolt so that said through holes allow a portion of the adhesive agent to be displaced out of a space disposed on said one face of the ID plate to a space disposed on the opposite face of the ID plate.

14. An identification plate attachment structure comprising:

a vehicular component;

an identification (ID) plate having one face opposed to said vehicular component and an opposite face, said ID plate having a bolt hole;

a bolt extending through said bolt hole of said ID plate and entering into said vehicular component, said bolt having a head; and an adhesive agent disposed between said vehicular component and said ID plate;

wherein said ID plate includes a passage structure adapted to permit said adhesive agent to enter into a space between said vehicular component and said one face of said ID plate and to flow through the passage structure into a space between the head of said bolt and the opposite face of said ID plate.

15. An identification plate attachment structure as claimed in claim 13, wherein said adhesive agent includes a first portion disposed between said vehicular component of said one face of said ID plate, a second portion disposed between said head of said bolt and said opposite face of said ID plate, and a third portion disposed in the passage structure.

16. An identification plate attachment structure as claimed in claim 14, wherein said ID plate is formed with a groove which separates a main portion and an attachment portion of said ID plate.

17. An identification plate attachment structure as claimed in claim 16, wherein said first portion of said adhesive agent fills a space between said vehicular component and said attachment portion of said ID plate, and said second portion of said adhesive agent fills a space between said head of said bolt and said attachment portion of said ID plate.

18. An identification plate attachment structure as claimed in claim 16, wherein said bolt hole and said passage structure are disposed in said attachment portion of said ID plate.

19. An identification plate attachment structure as claimed in claim 16, wherein a groove is formed on said one face of said ID plate which is disposed adjacent to said vehicular component.

20. An identification plate attachment structure as claimed in claim 19, wherein said groove has a V-shaped cross-sectional profile.

21. An identification plate attachment structure as claimed in claim 19, wherein said ID plate is provided with information on the opposite side thereof.

22. An identification plate attachment structure as claimed in claim 14, wherein said passage structure is disposed around said bolt hole.

23. An identification plate attachment structure as claimed in claim 14, wherein said passage structure includes a plurality of through holes extending from said one face of said ID plate to said opposite face of said ID plate.

24. An identification plate attachment structure as claimed in claim 14, wherein said passage structure includes a passage which is separate and discrete from said bolt hole.

* * * * *